United States Patent [19]

Werding

[11] Patent Number: 4,657,030

[45] Date of Patent: Apr. 14, 1987

[54] DEVICE FOR FILLING CIGARETTE PAPER TUBES

[75] Inventor: Wilfried J. Werding, Pully, Switzerland

[73] Assignee: Etablissements L. Lacroix Fils, Wilrijk, Belgium

[21] Appl. No.: 678,342

[22] Filed: Dec. 5, 1984

[30] Foreign Application Priority Data

Dec. 6, 1983 [CH] Switzerland ..... 4184/83

[51] Int. Cl.[4] ..... A24C 5/40; A24C 5/42; A24C 5/44

[52] U.S. Cl. ..... 131/70; 131/75

[58] Field of Search ..... 131/70, 75

[56] References Cited

FOREIGN PATENT DOCUMENTS 63339 9/1913 Austria ..... 131/70

*Primary Examiner*—V. Millin

*Attorney, Agent, or Firm*—McAulay, Fields, Fisher, Goldstein & Nissen

[57] ABSTRACT

Inside a casing comprised of a base plate and two side walls and a cover are mounted a plurality of rollers. The one roller is so supported in slots of the side walls as to be slidable crosswise to the lengthwise axis thereof. The rollers are enclosed by a flexible hose which forms a trough which can receive that tobacco to be converted into a cigatette. A tube-like part on the one side wall can receive a cigarette paper tube inside which the tobacco roll which has been formed between the rollers can be fed by means of the push-rod.

16 Claims, 4 Drawing Figures

DEVICE FOR FILLING CIGARETTE PAPER TUBES

This invention relates to a device for filling cigarette paper tubes, said device comprising a base plate, two side walls standing on said base plate, the one side wall being provided with a tube-like part projecting outwards and fitting inside the cigarette paper tube to be filled, the other side wall being provided with an opening opposite said tube-like part, at least one roller rotatingly supported in said side walls, a flexible strip surrounding partly at least said roller, and a push-rod extending through said opening with such a length as to be able to push a tobacco roll outside said tube-like part.

There are available in the trade, empty pre-glued tubes from cigarette paper, sometimes provided with a filter, which tubes may be filled according to one's own taste, with a self-prepared tobacco mixture. Such filling is however difficult as the tobacco has preferably to be fed in rolled condition into the tube, to insure normal air-flow and draught in the cigarette as same is being smoked.

The devices of the defined kind have for purpose to make such filling easier.

Such a device is known from German Pat. No. 246,061. In said known device, the base plate is provided in the upper surface thereof and on the back side with a lengthwise recess. The flexible strip is secured with the ends thereof in front and at the back to the base plate, and runs over the single roller. Said roller is movable between a back position in which it lies above said recess, the flexible strip then forming a trough for the tobacco, and a front position in which it lies on the front side relative to the tube-like part supported by the side wall. In said latter position, a tobacco roll is confined by the flexible strip behind said roller, directly opposite the tube-like part through which said roll may be pushed outside by means of the push-rod, after releasing said roller.

With said device, the tobacco is essentially pressed into a roll, but it is but very slightly rolled-up, which does not give a perfect filling.

The invention has for object to provide a device for filling cigarette paper tubes, which allows to obtain a better-quality filling with a well-rolled tobacco.

For this purpose, the device comprises besides said roller, three further rollers rotatingly mounted in said side walls, two rollers among the four rollers lying below the two other ones, the one upper roller being movably mounted between the side walls, between a position nearer the other upper roller, and a position farther away from said other roller, and the flexible strip is a hose surrounding the four-roller unit, hose by means of which said rollers may be rotated, the hose circumference being such as to have the hose form when the movable upper roller lies in said farther-away position thereof, a trough between the upper rollers which allows to receive the tobacco amount the cigarette paper tube is to be filled with, and there is formed when the movable upper roller lies in the nearer position thereof, a smaller recess between said four rollers, said smaller recess extending in the extension of said tube-like part.

In a particular embodiment of the invention, the inner circumference of the tube-like part is substantially tangent to the outer circumference of the lower rollers.

In an advantageous embodiment of the invention, both lower rollers have a diameter which is markedly smaller than the diameter of both upper rollers.

In a preferred embodiment of the invention, the device comprises a cover which is rotatingly mounted about a lengthwise axis between the side walls, said cover comprising at least one side wall which in the closed position of said cover, lies outside along that side wall standing on the base late and provided with said tube-like part, and bears firmly on said tube-like part or the cigarette paper tube which is threaded on said tube-like part.

Other details and features of the invention will stand out from the following description, given by way of non limitative example and with reference to the accompanying drawings, in which.

In the various figures, the same reference numerals pertain to identical elements.

Figure 1:
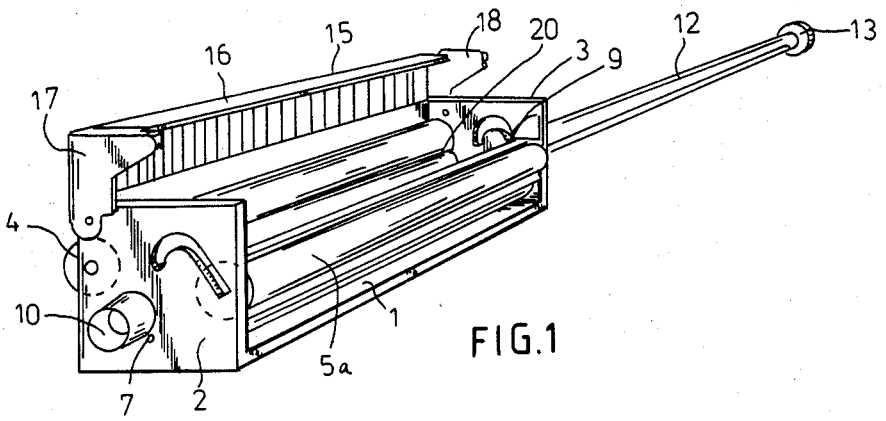
FIG. 1 is a perspective view of the device, ready to receive the tobacco.
Figure 2:
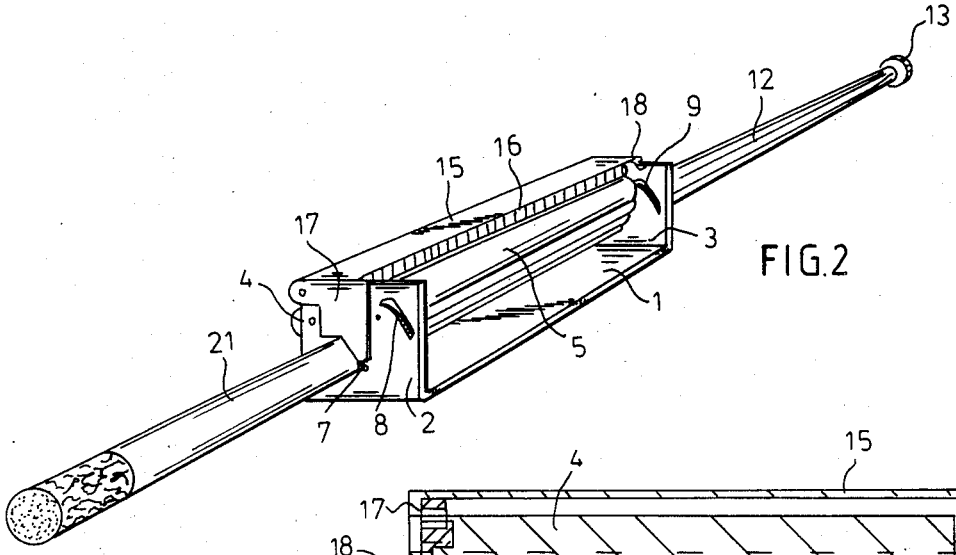
FIG. 2 is a perspective view of the device, ready to fill a cigarette paper tube.
Figure 3:
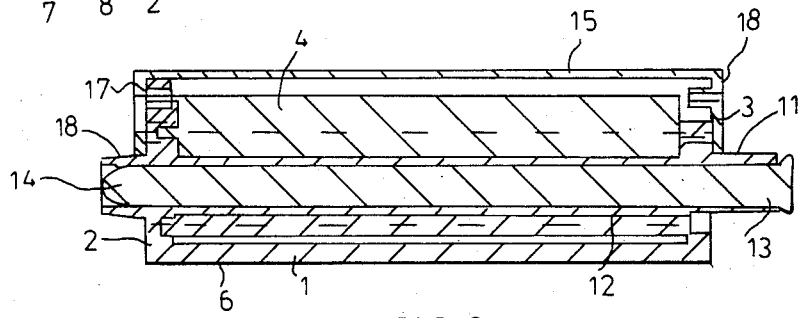
FIG. 3 is a section view of the device according to the invention.
Figure 4:
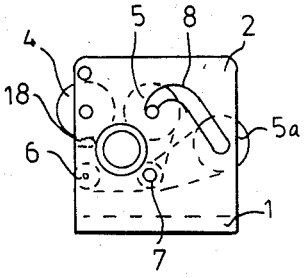
FIG. 4 is an elevation view of a side wall from the device.

The device as shown in the figures comprises a base plate 1.

The base plate 1 bears the side walls 2 and 3, in which are rotatingly supported two large rollers 4 and 5, as well as two smaller rollers 6 and 7 below said large rollers. The small rollers 6 and 7 have the same diameter which is at least smaller by 250% than the diameter of the large rollers 4 and 5 which also have the same diameter.

The roller 5 may by means of slots 8 and 9 in the side walls 2 and 3, be brought from a back position nearer said roller 4, in which position the roller is shown by reference numeral 5, to a front position, farther away thus from roller 4, in which position the roller is shown by reference numeral 5*a*. When the movable upper roller 5 lies in the back position thereof, the axes of the large upper rollers 4 and 5 lie vertically above the axes of the small lower rollers 6 and 7.

The spacing between the axes of the small lower rollers 6 and 7 lies between 9.5 and 10.5 mm.

The rollers 4, 5, 6 and 7 are surrounded by a tube or hose 20 from flexible material, the circumference of which is large enough to surround not only the four rollers, but also to form a lengthwise trough the diameter of which allows to receive that tobacco amount required for a cigarette when the movable roller 5 lies in the position 5*a* thereof removed from roller 4.

The length of rollers 4, 5, 6 and 7 and hose 20 is longer by at least 20% than the length of a completed cigarette.

The side walls 2 and 3 are each provided on the outside with a tube-like part 10 or 11 tapering outwardly. Said tube-like parts 10 and 11 directed outwards, face one another. A push-rod 12 which has at the one end thereof a disk 13 which serves as stop, while the other end 14 thereof is radiused, goes through the tube-like part 11 and may enter with the radiused end 14 thereof, the other tube-like 10.

The inner circumference of the tube-like parts 10 and 11 is substantially tangent to the outer circumference of the small lower rollers 6 and 7.

The largest outer diameter of the tapering tube-like parts 10 and 11 is equal to the inner diameter of that cigarette paper tube 21 to be filled.

The length of said push-rod 12 is so selected as to have the disk 13 on the one end thereof engage the tube-like part 11 when the opposite radiused end 14 is level with the free end of the tube-like part 10.

The side walls 2 and 3 further bear a cover 15 which has a lengthwise wall 16 and side walls 17 and 18. Said cover 15 is so designed as to have the lengthwise wall 16 come to lie during the closing, between rollers 4 and 5, while the side walls 17 and 18 firmly bear on the tube-like parts 10 and 11.

The circumference of hose 20 is such that it forms when the movable roller 5 lies in the position thereof nearer roller 4, between the four rollers 4, 5, 6 and 7, together with the boundary by lengthwise wall 16 of cover 15 in the closed position thereof, a tube the diameter of which is equal to or smaller than, and preferably smaller by at least 30% than the inner diameter of the cigarette paper tube 21 to be filled.

The device according to the invention operates as follows:

The push-rod 12 is first brought to the extended position thereof wherein the radiused end lies inside the tube-like part 11. The cover 15 is then opened.

With cover 15 open, the roller 5 is pulled to front position 5*a* thereof, in such a way that the hose 20 forms between said rollers 4 nd 5, a lengthwise trough in which that tobacco required for a cigrette is arranged in well-distributed condition. Thereafter, the roller 5 is brought back to the original back position thereof and with the thumbs, a clockwise revolution is imparted to said roller. The hose 20 then moves the rollers 4, 6 and 7 and rotates the tobacco into a roll. After some five revolutions, a tube 21 from cigarette paper is threaded over the tube-like part 10 and the cover is closed. Said cover locks with the lengthwise wall 16 thereof between rollers 4 and 5, and bears on the tobacco roll, not shown, while the side walls 17 and 18 thereof bear on the tube-like parts 10 and 11, the side wall 17 then clamping the cigarette paper tube 21. The left-hand forefinger then presses from below on the tube-like part 10, thus retaining tube 21 lying there, and simultaneously the thumb presses on cover 15. The push-rod 12 is then slowly slid into the device, until disk 13 engages said tube-like part 11, in such a way that the tobacco roll be slid inside the empty tube 21 and fills same. After opening cover 15, the filled tube 21 may be removed from said tube-like part 10, the rolled tobacco roll then expanding and filling completely said tube 21, while thus exerting a slight intended pressure on the inner wall thereof; the cigarette is now completed and the device according to the invention is again ready to be used.

It must be understood that the invention is in no way limited to the above-described embodiment and that many changes may be brought thereto without departing from the scope of the invention as defined by the appended claims.

What is claimed is:

1. A device for filling cigarette paper tubes comprising:

a base plate;

two side walls standing on said base plate, one of said walls being provided with a tube-like part projecting outwardly and fitting inside a cigarette paper tube to be filled, the other of said side walls being provided with an opening oppostie said tube-like part;

four rollers rotatingly mounted in said side walls;

a flexible hose partly surrounding at least one of said four rollers;

a push-rod extendable through said opening in said other side wall, said push rod having a length sufficient to push a tobacco roll outside said tube-like part;

two of said four rollers lying below the other two of said four rollers, one of said two upper rollers being movably mounted between the side walls between a position nearer the other of said two upper rollers and a position farther away from said other upper roller; and the flexible hose surrounding said four rollers to cause said four rollers to rotate the circumference of said hose such as to form a trough between the upper rollers to recieve tobacco for filling the cigarette paper tube when said movable upper roller lies in said farther-away position thereof, and to form a smaller recess between said four rollers when said movable upper roller lies in said smaller recess extending in the extension of said tube-like part.

2. The device of claim 1, in which the inner circumference of the tube-like part is substantially tangent to the outer circumference of the lower rollers.

3. The device of claim 1, in which both said lower rollers have a diameter which is markedly smaller than the diameter of both upper rollers.

4. The device of claim 3, in which the diameter of the small rollers is at least 250% smaller than the diameter of the larger rollers.

5. The device of claim 1, wherein the axes of the upper rollers when the movable upper roller lies in said nearer position thereof, lies at least substantially vertically above the axes of the lower rollers.

6. The device of claim 5 and further comprising a cover with a lengthwise wall and side walls, said lengthwise wall during closing of said cover lying between said lower rollers while said side walls bear on said tube-like parts.

7. The device of claim 6, in which said cover includes a downward-facing lengthwise wall which lies between said upper rollers when said cover is closed.

8. The device of claim 7, in which the circumference of said hose is selected to form a substantially round tube, the diameter of which is substantially equal to or smaller than the inner diameter of said tube-like part when the movable upper roller lies in the position thereof nearer the other upper roller between said four rollers.

9. The device of claim 8, in which the circumference of said flexible hose is such that when the movable upper roller lies in said nearer position thereof, said hose forms together with the boundary of lengthwise wall of the cover in the closed position thereof, a tube of the diameter of which is at least 30% smaller than the inner diameter of the cigarette paper tube to be filled.

10. The device of claim 1, in which the spacing between the axes of the lower rollers is between 9.5 and 10.5 mm.

11. The device of claim 1, wherein the length of the rollers and flexible hose is longer by at least 20% than the length of a completed cigarette.

12. The device of claim 1, in which the outer wall of said tube-like part is tapered, the largest diameter being substantially equal to the inner diameter of a cigarette paper tube to be filled.

13. The device of claim 1, in which the opening in the side wall opposite said tube-like part is also formed by a second tube-like part projecting outwards of said side wall.

14. The device of claim 13, in which said push-rod is provided at one end thereof with a stop, the length of the push-rod being selected as to let both ends thereof be supported inside the tube-like parts in such a way that said stop at one end engages one tube-like part when its opposite end lies level with the end of the other tube-like part.

15. The device of claim 13, in which the cover comprises two side walls, and a lengthwise wall, the cover side walls in the closed position of the cover bearing firmly on both tube-like parts, said lengthwise wall then lying between the upper rollers.

16. The device of claim 15, in which that end of the push-rod intended to push a tobacco roll outside said tube-like part is radiused.

* * * * *